US011547908B2

(12) United States Patent
Sajima

(10) Patent No.: US 11,547,908 B2
(45) Date of Patent: Jan. 10, 2023

(54) GOLF BALL

(71) Applicant: SUMITOMO RUBBER INDUSTRIES, LTD., Hyogo (JP)

(72) Inventor: Takahiro Sajima, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 17/078,393

(22) Filed: Oct. 23, 2020

(65) Prior Publication Data

US 2021/0138306 A1 May 13, 2021

(30) Foreign Application Priority Data

Nov. 7, 2019 (JP) ..... JP2019-201976

(51) Int. Cl.
*A63B 37/06* (2006.01)
*A63B 37/00* (2006.01)

(52) U.S. Cl.
CPC ..... *A63B 37/0087* (2013.01); *A63B 37/009* (2013.01); *A63B 37/0017* (2013.01); *A63B 37/0021* (2013.01); *A63B 37/0033* (2013.01); *A63B 37/0044* (2013.01); *A63B 37/0045* (2013.01); *A63B 37/0063* (2013.01); *A63B 37/0065* (2013.01); *A63B 37/0075* (2013.01); *A63B 37/0092* (2013.01); *A63B 37/0096* (2013.01)

(58) Field of Classification Search
CPC ..... A63B 37/0004; A63B 37/0062
USPC ..... 473/378, 373
See application file for complete search history.

(56) References Cited

U.S. PATENT DOCUMENTS 7,056,234 B2 * 6/2006 Kasashima ..... A63B 37/0004 473/384
2013/0307182 A1 * 11/2013 Okabe ..... A63B 45/00 264/255
2016/0184641 A1 * 6/2016 Shiga ..... A63B 37/0075 473/351

FOREIGN PATENT DOCUMENTS

JP 2004-49270 2/2004

OTHER PUBLICATIONS

Louis G. Caschera, Jr., Strictly Golf Balls The Golf Ball Handbook, 1998, Strictly Golf, Inc., p. 29. (Year: 1998).*

* cited by examiner

*Primary Examiner* — Raeann Gorden
(74) *Attorney, Agent, or Firm* — Greenblum & Bernstein, P.L.C.

(57) ABSTRACT

A golf ball has a core, an inner cover, an outer cover, and dimples. The golf ball satisfies the following mathematical formulas.

$$Sa=4500+10(A-0.5B-2Cs)\geq 4000$$

$$0.04Sa+160-20\leq D\leq 0.04Sa+160+20$$

A: a compression (Atti) of the golfball
B: a hardness difference (Shore C) between a surface and a center of the core
Cs: (Hi×Ti+2Ho×To)/(Ti+2To)
D: a total volume ($mm^3$) of the dimples
Hi: a hardness (Shore D) of the inner cover
Ho: a hardness (Shore D) of the outer cover
Ti: a thickness (mm) of the inner cover
To: a thickness (mm) of the outer cover

19 Claims, 4 Drawing Sheets

GOLF BALL

CROSS-REFERENCE TO RELATED APPLICATION

This application claims priority on and the benefit of Patent Application No. 2019-201976 filed in JAPAN on Nov. 7, 2019. The entire disclosures of this Japanese Patent Application are hereby incorporated by reference.

BACKGROUND OF THE INVENTION

Field of the Invention

The present invention relates to golf balls.

Specifically, the present invention relates to golf balls having a core, an inner cover, an outer cover, and dimples.

Description of the Related Art

A typical golf ball has a core, an inner cover, and an outer cover. The core is formed by crosslinking a rubber composition. The core can have two or more layers. The inner cover is formed from a resin composition. The outer cover is formed from another resin composition.

The face of a golf club has a loft angle. When a golf ball is hit with the golf club, the golf ball is launched at a launch angle corresponding to the loft angle. Furthermore, in the golf ball, backspin due to the loft angle occurs. The golf ball flies with the backspin.

Golf balls have a large number of dimples on the surfaces thereof. The dimples disturb the air flow around the golf ball during flight to cause turbulent flow separation. This phenomenon is referred to as "turbulization". Due to turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. Excellent dimples produce a large flight distance. There have been various proposals for dimples.

The greatest interest to golf players concerning golf balls is flight distance. Golf players particularly place importance on flight distances upon shots with drivers. Golf balls with which a large flight distance is achieved upon a shot with a driver can contribute to a good score.

A flight distance depends on the initial speed of the golf ball. The initial speed depends on a resilience coefficient. A golf ball that has a high resilience coefficient when being hit with a driver is advantageous in terms of flight distance.

An appropriate trajectory height is required in order to achieve a large flight distance. A trajectory height depends on a spin rate. With a golf ball that has a high spin rate, a large trajectory height is achieved.

Golf players also place importance on spin performance of golf balls. When the rate of backspin is high, the run is short. By using a golf ball having a high backspin rate, a golf player can cause the golf ball to stop at a target point. When the rate of sidespin is high, the golf ball tends to curve. By using a golf ball having a high sidespin rate, a golf player can intentionally cause the golf ball to curve. A golf ball having excellent spin performance has excellent controllability. Golf players particularly place importance on controllability upon an approach shot.

Various improvements have been proposed regarding the structures, materials, dimple patterns, etc., of golf balls for the purpose of improving flight performance. An example of the improvements is disclosed in JP2004-49270.

An excessive spin rate causes loss of kinetic energy. Therefore, a sufficient flight distance cannot be achieved with a golf ball in which the trajectory height greatly depends on the spin rate. On the other hand, a golf ball to which it is difficult to impart spin has inferior controllability.

An object of the present invention is to provide a golf ball that has an appropriate ball speed and an appropriate spin rate immediately after being hit and that has appropriate aerodynamic characteristics during flight.

SUMMARY OF THE INVENTION

A golf ball according to the present invention includes a core, an inner cover positioned outside the core, and an outer cover positioned outside the inner cover. The golf ball further has a plurality of dimples on a surface thereof. The golf ball satisfies the following mathematical formulas (III) and (V).

$$Sa=4500+10(A-0.5B-2Cs)\geq 4000 \quad \text{(III)}$$

$$0.04Sa+160-20\leq D\leq 0.04Sa+160+20 \quad \text{(V)}$$

A: a compression (Atti) of the golf ball

B: a hardness difference (Shore C) between a surface and a center of the core

Cs: (Hi×Ti+2Ho×To)/(Ti+2To)

D: a dimple total volume ($mm^3$)

Hi: a hardness (Shore D) of the inner cover

Ho: a hardness (Shore D) of the outer cover

Ti: a thickness (mm) of the inner cover

To: a thickness (mm) of the outer cover

In the golf ball according to the present invention, the balance between the hardness distribution of the core, the hardness and the thickness of the cover, and the compression of the golf ball is appropriate. When the golf ball is hit with a driver, the golf ball is launched at a high ball speed with an appropriate spin rate.

Furthermore, with the golf ball, a dimple effect that matches the spin rate is exhibited. The trajectory of the golf ball is appropriate. Upon a shot of the golf ball with a driver, a large flight distance can be achieved. Since the spin rate of the golf ball is appropriate, the golf ball also has excellent controllability.

Preferably, the golf ball further satisfies the following mathematical formula (I).

$$Vw=54+0.01(2.5A-B+5Cv)\geq 58.0 \quad \text{(I)}$$

Cv: (Hi×Ti+Ho×To)/(Ti+To)

Preferably, in the golf ball, a lift force coefficient CL satisfies the following mathematical formula (IV).

$$CLL\leq CL\leq CLU \quad \text{(IV)}$$

CLU: $Sw/60\times(-9.5\times10^{-6}\times D+6.1\times10^{-3})+(1.871\times10^{-4}\times D-3.5\times10^{-3})$ CLL: $Sw/60\times(-3.8\times10^{-6}\times D+3.0\times10^{-3})+(4.52\times10^{-5}\times D+8.32\times10^{-2})$ Sw: 3000+10(A−B−1.5Cs)

DESCRIPTION OF THE PREFERRED EMBODIMENTS

The following will describe in detail the present invention based on preferred embodiments with appropriate reference to the drawings.

Figure 1:
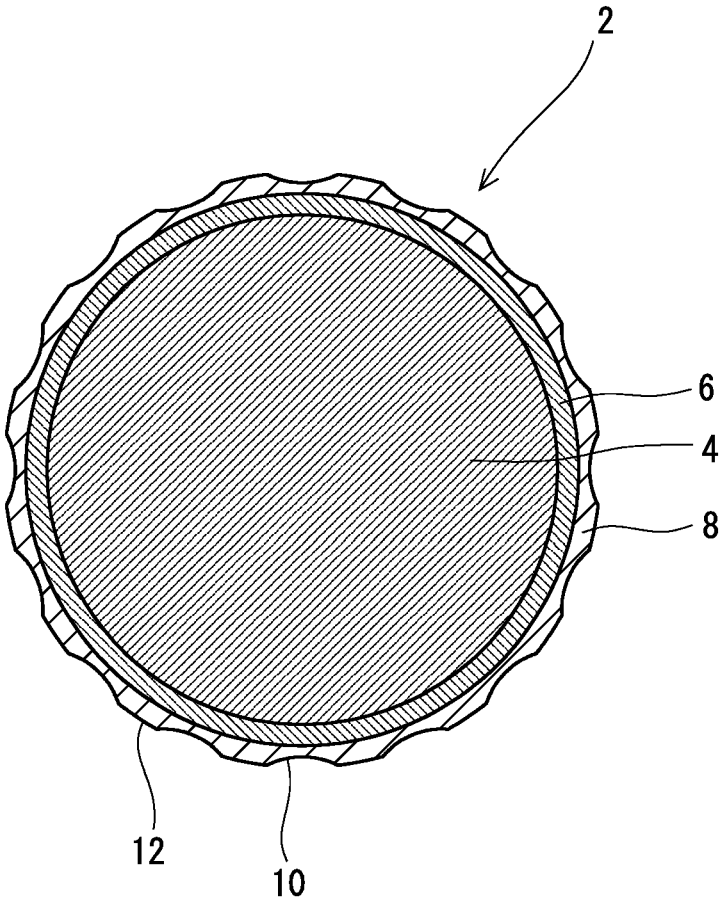
FIG. 1 is a schematic cross-sectional view of a golf ball according to an embodiment of the present invention.

A golf ball 2 shown in FIG. 1 includes a spherical core 4, an inner cover 6 positioned outside the core 4, and an outer cover 8 positioned outside the inner cover 6. The golf ball 2 has a plurality of dimples 10 on the surface thereof. Of the surface of the golf ball 2, a part other than the dimples 10 is a land 12. The golf ball 2 includes a paint layer and a mark layer on the external side of the outer cover 8, but these layers are not shown in the drawing.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

The core 4 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance of the golf ball 2, polybutadienes are preferable. When a polybutadiene and another rubber are used in combination, it is preferred if the polybutadiene is a principal component. Specifically, the proportion of the polybutadiene to the entire base rubber is preferably not less than 50% by weight and particularly preferably not less than 80% by weight. A polybutadiene in which the proportion of cis-1,4 bonds is not less than 80% is particularly preferable.

The rubber composition of the core 4 preferably includes a co-crosslinking agent. Preferable co-crosslinking agents in light of durability and resilience performance of the golf ball 2 are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. Zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

The amount of the co-crosslinking agent per 100 parts by weight of the base rubber is preferably not less than 10 parts by weight and not greater than 45 parts by weight. The golf ball 2 in which this amount is not less than 10 parts by weight has excellent resilience performance. From this viewpoint, this amount is more preferably not less than 15 parts by weight and particularly preferably not less than 20 parts by weight. The golf ball 2 in which this amount is not greater than 45 parts by weight has excellent feel at impact. From this viewpoint, this amount is more preferably not greater than 40 parts by weight and particularly preferably not greater than 35 parts by weight.

Preferably, the rubber composition of the core 4 includes an organic peroxide. The organic peroxide serves as a crosslinking initiator. The organic peroxide contributes to the durability and the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

The amount of the organic peroxide per 100 parts by weight of the base rubber is preferably not less than 0.1 parts by weight and not greater than 3.0 parts by weight. The golf ball 2 in which this amount is not less than 0.1 parts by weight has excellent resilience performance. From this viewpoint, this amount is more preferably not less than 0.3 parts by weight and particularly preferably not less than 0.5 parts by weight. The golf ball 2 in which this amount is not greater than 3.0 parts by weight has excellent feel at impact. From this viewpoint, this amount is more preferably not greater than 2.5 parts by weight and particularly preferably not greater than 2.0 parts by weight.

Preferably, the rubber composition of the core 4 includes an organic sulfur compound. The organic sulfur compound contributes to flight distance upon a shot with a driver. Organic sulfur compounds include naphthalenethiol compounds, benzenethiol compounds, and disulfide compounds.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

The amount of the organic sulfur compound per 100 parts by weight of the base rubber is preferably not less than 0.1 parts by weight and not greater than 1.5 parts by weight. The golf ball 2 in which this amount is not less than 0.1 parts by weight has excellent resilience performance. From this viewpoint, this amount is more preferably not less than 0.2 parts by weight and particularly preferably not less than 0.3 parts by weight. The golf ball 2 in which this amount is not greater than 1.5 parts by weight has excellent feel at impact. From this viewpoint, this amount is more preferably not greater than 1.0 part by weight and particularly preferably not greater than 0.8 parts by weight. Two or more organic sulfur compounds may be used in combination.

Preferably, the rubber composition of the core 4 includes a carboxylic acid or a carboxylate. The carboxylic acid and the carboxylate can contribute to making the hardness distribution of the core 4 appropriate. An example of preferable carboxylic acids is benzoic acid. Examples of preferable carboxylates include zinc octoate and zinc stearate. The amount of the carboxylic acid and the carboxylate per 100 parts by weight of the base rubber is preferably not less than 0.5 parts by weight, more preferably not less than 0.8 parts by weight, and particularly preferably not less than 1.0 part by weight. This amount is preferably not greater than 20 parts by weight, more preferably not greater than 15 parts by weight, and particularly preferably not greater than 10 parts by weight.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is achieved.

The rubber composition of the core 4 may include various additives, such as sulfur, an anti-aging agent, a coloring agent, a plasticizer, a dispersant, and the like, in an adequate amount. The rubber composition may include crosslinked rubber powder or synthetic resin powder.

The core 4 preferably has a diameter of not less than 35.0 mm and not greater than 40.5 mm. The golf ball 2 that includes the core 4 having a diameter of not less than 35.0 mm has excellent resilience performance. From this viewpoint, the diameter is more preferably not less than 36.0 mm and particularly preferably not less than 36.5 mm. The golf ball 2 that includes the core 4 having a diameter of not greater than 40.5 mm has excellent durability. From this viewpoint, the diameter is more preferably not greater than 40.0 mm and particularly preferably not greater than 39.5 mm.

A hardness Hc at the central point of the core 4 is preferably not less than 35 and not greater than 70. The golf ball 2 in which the hardness Hc is not less than 35 has excellent resilience performance. From this viewpoint, the hardness Hc is more preferably not less than 40 and particularly preferably not less than 45. The golf ball 2 in which the hardness Hc is not greater than 70 has excellent feel at impact. From this viewpoint, the hardness Hc is more preferably not greater than 67 and particularly preferably not greater than 65.

The hardness Hc is measured with a Shore C type hardness scale mounted to an automated hardness meter (trade name "digi test II" manufactured by Heinrich Bareiss Prüfgerätebau GmbH). The hardness scale is pressed against the central point of the cross-section of a hemisphere obtained by cutting the golf ball 2. The measurement is conducted in an environment of 23° C.

A hardness Hs at the surface of the core 4 is preferably not less than 55 and not greater than 95. The golf ball 2 in which the hardness Hs is not less than 55 has excellent resilience performance. From this viewpoint, the hardness Hs is more preferably not less than 60 and particularly preferably not less than 65. The golf ball 2 in which the hardness Hs is not greater than 95 has excellent feel at impact. From this viewpoint, the hardness Hs is more preferably not greater than 90 and particularly preferably not greater than 85.

The hardness Hs is measured with a Shore C type hardness scale mounted to an automated hardness meter (trade name "digi test II" manufactured by Heinrich Bareiss Prüfgerätebau GmbH). The hardness scale is pressed against the surface of the core 4. The measurement is conducted in an environment of 23° C.

The difference B (=Hs−Hc) between the hardness Hs at the surface of the core 4 and the hardness Hc at the center of the core 4 is preferably not less than 0 and not greater than 40. The golf ball 2 having the core 4 in which the difference B is not less than 0 can fly with an appropriate spin rate. From this viewpoint, the difference B is more preferably not less than 10 and particularly preferably not less than 15. The core 4 in which the difference B is not greater than 40 is easily produced. From this viewpoint, the difference B is more preferably not greater than 37 and particularly preferably not greater than 35.

The core 4 preferably has an amount of compressive deformation Df of not less than 3.0 mm and not greater than 4.5 mm. The golf ball 2 having the core 4 having an amount of compressive deformation Df of not less than 3.0 mm has excellent feel at impact. From this viewpoint, the amount of compressive deformation Df is more preferably not less than 3.2 mm and particularly preferably not less than 3.3 mm. When the golf ball 2 having the core 4 having an amount of compressive deformation Df of not greater than 4.5 mm is hit with a driver, the golf ball 2 can be launched at a high initial speed. From this viewpoint, the amount of compressive deformation Df is more preferably not greater than 4.4 mm and particularly preferably not greater than 4.3 mm.

For measurement of the amount of compressive deformation Df, a YAMADA type compression tester "SCH" is used. In the tester, the core 4 is placed on a hard plate made of metal. Next, a cylinder made of metal gradually descends toward the core 4. The core 4, squeezed between the bottom face of the cylinder and the hard plate, becomes deformed. A migration distance of the cylinder, starting from the state in which an initial load of 98 N is applied to the core 4 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

The core 4 preferably has a weight of not less than 10 g and not greater than 42 g. The temperature Te for crosslinking the core 4 is not lower than 140° C. and not higher than 180° C. The time period Tm for crosslinking the core 4 is not shorter than 10 minutes and not longer than 60 minutes. The core 4 may have two or more layers.

The inner cover 6 is positioned outside the core 4. The inner cover 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the inner cover 6 including an ionomer resin has excellent resilience performance. The golf ball 2 has excellent flight distance upon a shot with a driver.

An ionomer resin and another resin may be used in combination. In this case, in light of resilience performance, the ionomer resin is included as the principal component of the base polymer. The proportion of the ionomer resin to the entire base polymer is preferably not less than 50% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ions, potassium ions, lithium ions, zinc ions, calcium ions, magnesium ions, aluminum ions, and neodymium ions. The neutralization may be carried out with two or more types of metal ions. Particularly suitable metal ions in light of resilience performance and durability of the golf ball 2 are sodium ions, zinc ions, lithium ions, and magnesium ions.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by DOW-MITSUI POLYCHEMICALS CO., LTD.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

Preferably, the resin composition of the inner cover 6 includes a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably not less than 10% by weight, more preferably not less than 12% by weight, and particularly preferably not less than 15% by weight. In light of feel at impact of the golf ball 2, the content is preferably not greater than 50% by weight, more preferably not greater than 47% by weight, and particularly preferably not greater than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. The alloy can contribute to the resilience performance of the golf ball 2. An olefin having 2 to 10 carbon atoms is preferable. Examples of suitable olefins include ethylene, propylene, butene, and pentene. Ethylene and propylene are particularly preferable.

Specific examples of polymer alloys include trade names "TEFABLOC T3221C", "TEFABLOC T3339C", "TEFABLOC SJ4400N", "TEFABLOC SJ5400N", "TEFABLOC SJ6400N", "TEFABLOC SJ7400N", "TEFABLOC SJ8400N", "TEFABLOC SJ9400N", and "TEFABLOC SR04", manufactured by Mitsubishi Chemical Corporation. Other specific examples of styrene block-containing thermoplastic elastomers include trade name "Epofriend A1010" manufactured by Daicel Corporation, and trade name "SEPTON HG-252" manufactured by Kuraray Co., Ltd.

In light of feel at impact, the proportion of the styrene block-containing thermoplastic elastomer to the entire base polymer is preferably not less than 10% by weight, more preferably not less than 15% by weight, and particularly preferably not less than 20% by weight. In light of resilience performance, this proportion is preferably not greater than 50% by weight.

The resin composition of the inner cover 6 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The inner cover 6 preferably has a thickness Ti of not less than 0.50 mm and not greater than 1.50 mm. The golf ball 2 in which the thickness Ti is not less than 0.50 mm has excellent feel at impact. From this viewpoint, the thickness Ti is more preferably not less than 0.70 mm and particularly preferably not less than 0.80 mm. The golf ball 2 in which the thickness Ti is not greater than 1.50 mm has excellent resilience performance. From this viewpoint, the thickness Ti is more preferably not greater than 1.30 mm and particularly preferably not greater than 1.20 mm. The thickness is measured at a position immediately below the land 12.

The inner cover 6 preferably has a hardness Hi of not less than 25 and not greater than 75. The golf ball 2 in which the hardness Hi is not less than 25 has excellent resilience performance. From this viewpoint, the hardness Hi is more preferably not less than 30 and particularly preferably not less than 35. The golf ball 2 in which the hardness Hi is not greater than 75 has excellent feel at impact. From this viewpoint, the hardness Hi is more preferably not greater than 72 and particularly preferably not greater than 70.

The hardness Hi of the inner cover 6 is measured according to the standards of "ASTM-D 2240-68". The hardness Hi is measured with a Shore D type hardness scale mounted to an automated hardness meter (trade name "digi test II" manufactured by Heinrich Bareiss Prüfgerätebau GmbH). For the measurement, a sheet that is formed by hot press, is formed from the same material as that of the inner cover 6, and has a thickness of about 2 mm, is used. Prior to the measurement, a sheet is kept at 23° C. for two weeks. At the time of measurement, three sheets are stacked.

The outer cover 8 is positioned outside the inner cover 6. The outer cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the outer cover 8 including an ionomer resin has excellent resilience performance. The golf ball 2 has excellent flight distance upon a shot with a driver. The ionomer resin described above for the inner cover 6 can be used for the outer cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the outer cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The outer cover 8 preferably has a thickness To of not less than 0.50 mm and not greater than 2.30 mm. In the golf ball 2 in which the thickness To is not less than 0.50 mm, the outer cover 8 can contribute to resilience performance. From this viewpoint, the thickness To is more preferably not less than 0.70 mm and particularly preferably not less than 0.80 mm. In the golf ball 2 in which the thickness To is not greater than 2.30 mm, the outer cover 8 does not impair feel at impact. From this viewpoint, the thickness To is more preferably not greater than 2.20 mm and particularly preferably not greater than 2.10 mm. The thickness is measured at a position immediately below the land 12.

The ratio (Ti/To) of the thickness Ti of the inner cover 6 to the thickness To of the outer cover 8 is preferably not less than 0.3 and not greater than 3.0.

The outer cover 8 preferably has a hardness Ho of not less than 30 and not greater than 75. The golf ball 2 in which the hardness Ho is not less than 30 has excellent resilience performance. From this viewpoint, the hardness Ho is more preferably not less than 40 and particularly preferably not less than 45. The golf ball 2 in which the hardness Ho is not greater than 75 has excellent feel at impact. From this viewpoint, the hardness Ho is more preferably not greater than 72 and particularly preferably not greater than 70.

The hardness Ho of the outer cover 8 is measured according to the standards of "ASTM-D 2240-68". The hardness Ho is measured with a Shore D type hardness scale mounted to an automated hardness meter (trade name "digi test II" manufactured by Heinrich Bareiss Prüfgerätebau GmbH). For the measurement, a sheet that is formed by hot press, is formed from the same material as that of the outer cover 8, and has a thickness of about 2 mm, is used. Prior to the measurement, a sheet is kept at 23° C. for two weeks. At the time of measurement, three sheets are stacked.

An index Cv relates to the specifications of the inner cover 6 and the outer cover 8. The index Cv correlates with the initial speed of the golf ball 2 when the golf ball 2 is hit with a driver. The index Cv is calculated by the following mathematical formula.

$$Cv=(Hi\times Ti+Ho\times To)/(Ti+To)$$

The index Cv is preferably not less than 25 and not greater than 75, more preferably not less than 40 and not greater than 60, and particularly preferably not less than 45 and not greater than 55.

An index Cs relates to the specifications of the inner cover 6 and the outer cover 8. The index Cs correlates with the spin rate of the golf ball 2 when the golf ball 2 is hit with a driver. The index Cs is calculated by the following mathematical formula.

$$Cs=(Hi\times Ti+2Ho\times To)/(Ti+2To)$$

The index Cs is preferably not less than 25 and not greater than 75, more preferably not less than 35 and not greater than 65, and particularly preferably not less than 42 and not greater than 60.

The golf ball 2 preferably has a compression A of not less than 20 and not greater than 120. When the golf ball 2 having a compression A of not less than 20 is hit with a driver, the golf ball 2 can be launched at a high initial speed. From this viewpoint, the compression A is more preferably not less than 50 and particularly preferably not less than 70. The golf ball 2 having a compression A of not greater than 120 has excellent feel at impact. From this viewpoint, the compression A is more preferably not greater than 110 and particularly preferably not greater than 105.

The compression A can be measured with an ATTI compression tester manufactured by Atti Engineering Company.

Figure 2:
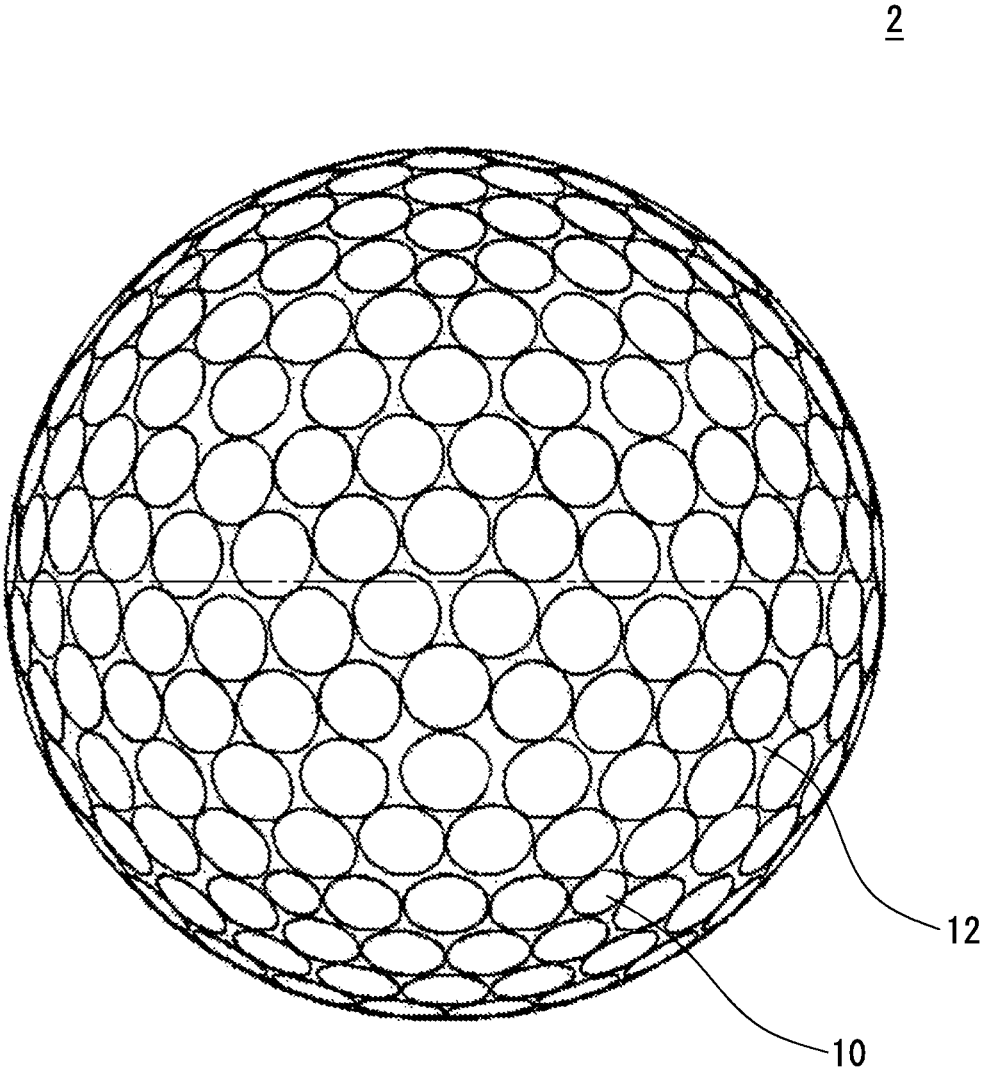
FIG. 2 is an enlarged front view of the golf ball in FIG. 1.
Figure 3:
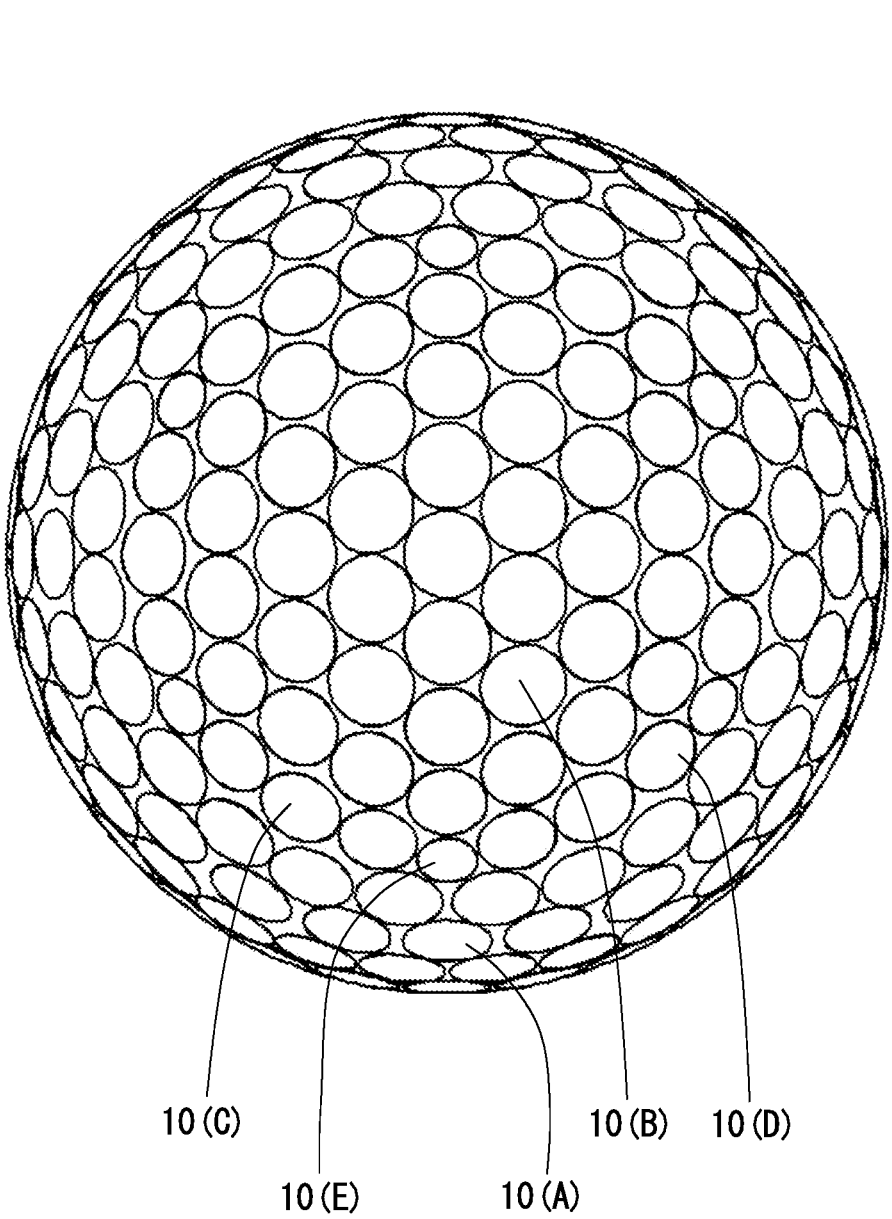
FIG. 3 is a plan view of the golf ball in FIG. 2.

As shown in FIGS. 2 and 3, the golf ball 2 has a large number of dimples 10 on the surface thereof. The contour of each dimple 10 is circular. The golf ball 2 has dimples A each having a diameter of 4.40 mm; dimples B each having a diameter of 4.28 mm; dimples C each having a diameter of 4.14 mm; dimples D each having a diameter of 3.90 mm; and dimples E each having a diameter of 3.60 mm. The number of types of the dimples 10 is five.

The number of the dimples A is 60; the number of the dimples B is 158; the number of the dimples C is 72; the number of the dimples D is 36; and the number of the dimples E is 12. The total number of the dimples 10 is 338. A dimple pattern is formed by these dimples 10 and the land 12.

Figure 4:
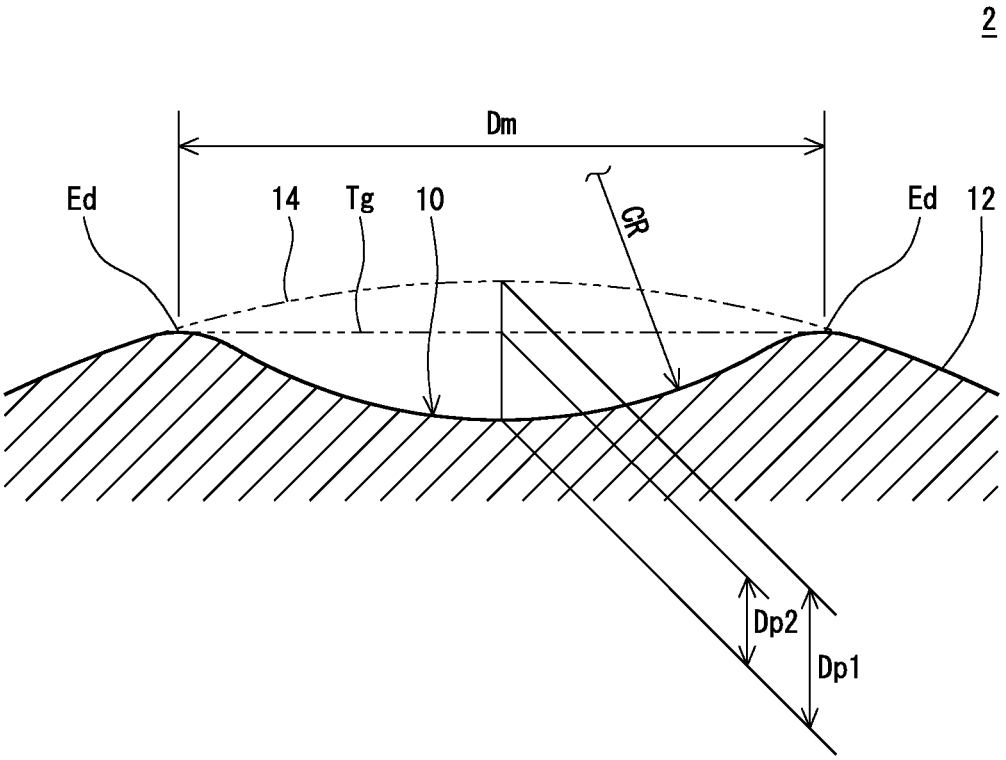
FIG. 4 is a partially enlarged cross-sectional view of the golf ball in FIG. 1.

FIG. 4 shows a cross section of the golf ball 2 along a plane passing through the central point of the dimple 10 and the central point of the golf ball 2. In FIG. 4, the top-to-bottom direction is the depth direction of the dimple 10. In FIG. 4, a chain double-dashed line 14 indicates a phantom sphere. The surface of the phantom sphere 14 is the surface of the golf ball 2 when it is postulated that no dimple 10 exists. The diameter of the phantom sphere 14 is equal to the diameter of the golf ball 2. The dimple 10 is recessed from the surface of the phantom sphere 14. The land 12 coincides with the surface of the phantom sphere 14. In the present embodiment, the cross-sectional shape of each dimple 10 is substantially a circular arc. The curvature radius of this circular arc is shown by reference character CR in FIG. 4.

In FIG. 4, an arrow Dm indicates the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10.

The diameter Dm of each dimple 10 is preferably not less than 2.0 mm and not greater than 6.0 mm. The dimple 10 having a diameter Dm of not less than 2.0 mm contributes to turbulization. From this viewpoint, the diameter Dm is more preferably not less than 2.5 mm and particularly preferably not less than 2.8 mm. The dimple 10 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In FIG. 4, a double ended arrow Dp1 indicates a first depth of the dimple 10. The first depth Dp1 is the distance between the deepest part of the dimple 10 and the surface of the phantom sphere 14. In FIG. 4, a double ended arrow Dp2 indicates a second depth of the dimple 10. The second depth Dp2 is the distance between the deepest part of the dimple 10 and the tangent line Tg.

In light of suppression of rising of the golf ball 2 during flight, the first depth Dp1 of each dimple 10 is preferably not less than 0.10 mm, more preferably not less than 0.13 mm, and particularly preferably not less than 0.15 mm. In light of suppression of dropping of the golf ball 2 during flight, the first depth Dp1 is preferably not greater than 0.65 mm, more preferably not greater than 0.60 mm, and particularly preferably not greater than 0.55 mm.

The area S of the dimple 10 is the area of a region surrounded by the contour line of the dimple 10 when the central point of the golf ball 2 is viewed at infinity. In the case of the dimple 10 which has a circular shape, the area S is calculated by the following mathematical formula.

$$S=(Dm/2)^2*\pi$$

In the golf ball 2 shown in FIGS. 2 and 3, the area of each dimple A is 15.20 $mm^2$; the area of each dimple B is 14.39 $mm^2$; the area of each dimple C is 13.46 $mm^2$; the area of each dimple D is 11.95 $mm^2$; and the area of each dimple E is 10.18 $mm^2$.

In the present invention, the ratio of the sum of the areas S of all the dimples 10 relative to the surface area of the phantom sphere 14 is referred to as an occupation ratio So. From the viewpoint of achieving sufficient turbulization, the occupation ratio So is preferably not less than 78%, more preferably not less than 80%, and particularly preferably not less than 82%. The occupation ratio So is preferably not greater than 95%. In the golf ball 2 shown in FIGS. 2 and 3, the total area of the dimples 10 is 4707 $mm^2$. The surface area of the phantom sphere 14 of the golf ball 2 is 5728 $mm^2$, so that the occupation ratio So is 82.2%.

From the viewpoint of achieving a sufficient occupation ratio So, the total number of the dimples 10 is preferably not less than 250, more preferably not less than 280, and particularly preferably not less than 300. From the viewpoint that each dimple 10 can contribute to turbulization, the total number is preferably not greater than 450, more preferably not greater than 410, and particularly preferably not greater than 390.

In the present invention, the "volume of the dimple" means the volume of a portion surrounded by the surface of the dimple 10 and the plane including the contour of the dimple 10. The total volume D of the dimples 10 is preferably not less than 200 $mm^3$ and not greater than 500 $mm^3$. With the golf ball 2 in which the total volume D is not less than 200 $mm^3$, rising of the golf ball 2 during flight is suppressed. From this viewpoint, the total volume D is more preferably not less than 250 $mm^3$ and particularly preferably not less than 270 $mm^3$. With the golf ball 2 in which the total volume D is not greater than 500 $mm^3$, dropping of the golf ball 2 during flight is suppressed. From this viewpoint, the total volume D is more preferably not greater than 400 $mm^3$ and particularly preferably not greater than 370 $mm^3$.

In the golf ball 2 shown in FIGS. 2 and 3, the volume of each dimple A is 1.009 $mm^3$; the volume of each dimple B is 0.954 $mm^3$; the volume of each dimple C is 0.842 $mm^3$; the volume of each dimple D is 0.715 $mm^3$; and the volume of each dimple E is 0.607 $mm^3$. Therefore, the sum D of the volumes of all the dimples 10 is 305 $mm^3$.

The golf ball 2 satisfies the following mathematical formulas (III) and (V).

$$Sa=4500+10(A-0.5B-2Cs)\geq 4000 \quad \text{(III)}$$

$$0.04Sa+160-20\leq D\leq 0.04Sa+160+20 \quad \text{(V)}$$

A: the compression (Atti) of the golf ball 2

B: the hardness difference (Shore C) between the surface and the center of the core 4

Cs: (Hi×Ti+2Ho×To)/(Ti+2To)

D: the dimple total volume ($mm^3$)

Hi: the hardness (Shore D) of the inner cover 6

Ho: the hardness (Shore D) of the outer cover 8

Ti: the thickness (mm) of the inner cover 6

To: the thickness (mm) of the outer cover 8

In the golf ball 2 that satisfies the mathematical formula (III), the index Sa is not less than 4000. When the golf ball 2 in which the index Sa is not less than 4000 is hit with a golf club, the golf ball 2 is launched with an appropriate spin rate. The golf ball 2 has excellent flight performance and controllability. From these viewpoints, the index Sa is more preferably not less than 4050 and particularly preferably not less than 4100. The index Sa is preferably not greater than 4700, more preferably not greater than 4650, and particularly preferably not greater than 4600.

In the golf ball 2 that satisfies the mathematical formulas (III) and (V), the balance between the lift force caused due to spin and the lift force caused due to the dimples 10 is appropriate. With the golf ball 2, there is little loss of kinetic energy. When the golf ball 2 is hit with a driver, the trajectory height and the flight duration are appropriate. The golf ball 2 has excellent flight performance upon a shot with a driver. In light of flight performance, the golf ball 2 more preferably satisfies the following mathematical formula.

$$0.04Sa+160-15\leq D\leq 0.04Sa+160+15$$

In light of flight performance, the golf ball 2 particularly preferably satisfies the following mathematical formula.

$$0.04Sa+160-10\leq D\leq 0.04Sa+160+10$$

Preferably, the golf ball 2 satisfies the following mathematical formula (I).

$$Vw=54+0.01(2.5A-B+5Cv)\geq 58.0 \quad \text{(I)}$$

In the golf ball 2 that satisfies the mathematical formula (I), the index Vw is not less than 58.0. When the golf ball 2 in which the index Vw is not less than 58.0 is hit with a driver, the golf ball 2 is launched at a high initial speed. The golf ball 2 has excellent flight performance upon a shot with a driver. In light of flight performance, the index Vw is more preferably not less than 58.2 and particularly preferably not less than 58.4. The index Vw is preferably not greater than 59.5, more preferably not greater than 59.3, and particularly preferably not greater than 59.1.

Preferably, a lift force coefficient CL of the golf ball 2 satisfies the following mathematical formula (IV).

$$CLL \leq CL \leq CLU \quad \text{(IV)}$$

CLU: $Sw/60\times(-9.5\times10^{-6}\times D+6.1\times10^{-3})+(1.871\times10^{-4}\times D-3.5\times10^{-3})$ CLL: $Sw/60\times(-3.8\times10^{-6}\times D+3.0\times10^{-3})+(4.52\times10^{-5}\times D+8.32\times10^{-2})$ Sw: $3000+10(A-B-1.5Cs)$ In the golf ball 2 that satisfies the mathematical formula (IV), the lift force caused due to the dimples 10 is appropriate. With the golf ball 2, rising and dropping of the golf ball 2 during flight are suppressed. The golf ball 2 has excellent flight performance upon a shot with a driver.

EXAMPLES

The following will show the effects of the present invention by means of Examples, but the present invention should not be construed in a limited manner on the basis of the description of these Examples.

Example 1

A rubber composition was obtained by kneading 100 parts by weight of a high-cis polybutadiene (trade name "BR-730", manufactured by JSR Corporation), an appropriate amount of zinc diacrylate, 5 parts by weight of zinc oxide, an appropriate amount of barium sulfate, 2.0 parts by weight of benzoic acid, 0.5 parts by weight of diphenyl disulfide, and 0.9 parts by weight of dicumyl peroxide. This rubber composition was placed into a mold including upper and lower mold halves each having a hemispherical cavity, and heated to obtain a core with a diameter of 38.2 mm. The amount of zinc diacrylate was adjusted such that a predetermined amount of compressive deformation Df was obtained. The amount of barium sulfate was adjusted such that a core having a predetermined weight was obtained. The crosslinking temperature Te was 160° C. The crosslinking time period Tm was 20 minutes.

A resin composition a was obtained by kneading 30 parts by weight of an ionomer resin (the aforementioned "Himilan AM7337"), 30 parts by weight of another ionomer resin (the aforementioned "Himilan AM7329"), 40 parts by weight of a styrene block-containing thermoplastic elastomer (the aforementioned "TEFABLOC T3221C"), 4 parts by weight of titanium dioxide, and 0.2 parts by weight of a light stabilizer (trade name "JF-90", manufactured by Johoku Chemical Co., Ltd.) with a twin-screw kneading extruder. The core was placed into a mold including upper and lower mold halves each having a hemispherical cavity. The core was covered with the resin composition a by injection molding to form an inner cover. The thickness of the inner cover was 1.00 mm.

A resin composition c was obtained by kneading 40 parts by weight of an ionomer resin (the aforementioned "Himilan AM7329"), 52 parts by weight of another ionomer resin (the aforementioned "Himilan 1605"), 8 parts by weight of a styrene block-containing thermoplastic elastomer (the aforementioned "TEFABLOC T3221C"), 4 parts by weight of titanium dioxide, and 0.2 parts by weight of a light stabilizer (the aforementioned "JF-90") with a twin-screw kneading extruder. The sphere consisting of the core and the inner cover was placed into a mold including upper and lower mold halves each having a hemispherical cavity. The sphere was covered with the resin composition c by injection molding to form an outer cover. The thickness of the outer cover was 1.25 mm.

A clear paint including a two-component curing type polyurethane as a base material was applied to this outer cover to obtain a golf ball of Example 1 with a diameter of about 42.7 mm and a weight of about 45.6 g. Dimple specifications I-1 of the golf ball are shown in detail in Tables 2 and 3 below. FIG. 2 is a plan view of the golf ball, and FIG. 3 is a front view of the golf ball.

Examples 2 to 21 and Comparative Examples 1 to 15

Golf balls of Examples 2 to 21 and Comparative Examples 1 to 15 were obtained in the same manner as Example 1, except the specifications of the core, the inner cover, the outer cover, and the dimples were as shown in Tables 4 to 9 below. The compositions of the inner cover and the outer cover are shown in detail in Table 1 below. The specifications of the dimples are shown in detail in Tables 2 and 3 below.

[Flight Test]

A driver with a head made of a titanium alloy (trade name "XXIO 9", manufactured by Sumitomo Rubber Industries, Ltd., shaft hardness: R, loft angle: 10.5°) was attached to a swing machine manufactured by Golf Laboratories, Inc. A golf ball was hit under a condition of a head speed of 40 m/sec, and the flight distance was measured. The flight distance is the distance from the launch point to the stop point. During the test, the weather was almost windless. The average value of data obtained by 12 measurements is shown in Tables 4 to 9 below.

TABLE 1

Composition of Cover (parts by weight)

| | a | b | c | d |
|---|---|---|---|---|
| Himilan AM7337 | 30 | 40 | — | — |
| Himilan AM7329 | 30 | 40 | 40 | 50 |
| Himilan #1605 | — | — | 52 | 42 |
| Surlyn #8150 | — | — | — | 8 |
| TEFABLOC T3221C | 40 | 20 | 8 | — |
| Titanium dioxide | 4 | 4 | 4 | 4 |
| JF-90 | 0.2 | 0.2 | 0.2 | 0.2 |
| Hardness (Shore D) | 40 | 52 | 59 | 66 |

TABLE 2

Specifications of Dimples

| | Type | Number | Dm (mm) | Dp2 (mm) | Dp1 (mm) | CR (mm) | Volume ($mm^3$) |
|---|---|---|---|---|---|---|---|
| I-1 | A | 60 | 4.40 | 0.1325 | 0.2462 | 18.33 | 1.009 |
| | B | 158 | 4.28 | 0.1325 | 0.2400 | 17.35 | 0.954 |
| | C | 72 | 4.14 | 0.1250 | 0.2256 | 17.20 | 0.842 |
| | D | 36 | 3.90 | 0.1195 | 0.2087 | 15.97 | 0.715 |
| | E | 12 | 3.60 | 0.1190 | 0.1950 | 13.67 | 0.607 |
| I-2 | A | 60 | 4.40 | 0.1410 | 0.2547 | 17.23 | 1.073 |
| | B | 158 | 4.28 | 0.1410 | 0.2485 | 16.31 | 1.016 |
| | C | 72 | 4.14 | 0.1335 | 0.2341 | 16.12 | 0.900 |
| | D | 36 | 3.90 | 0.1280 | 0.2172 | 14.92 | 0.766 |
| | E | 12 | 3.60 | 0.1275 | 0.2035 | 12.77 | 0.650 |

TABLE 2-continued

| Specifications of Dimples | | | | | | | |
|---|---|---|---|---|---|---|---|
| | Type | Number | Dm (mm) | Dp2 (mm) | Dp1 (mm) | CR (mm) | Volume ($mm^3$) |
| I-3 | A | 60 | 4.40 | 0.1495 | 0.2632 | 16.26 | 1.138 |
| | B | 158 | 4.28 | 0.1495 | 0.2570 | 15.39 | 1.077 |
| | C | 72 | 4.14 | 0.1420 | 0.2426 | 15.16 | 0.957 |
| | D | 36 | 3.90 | 0.1360 | 0.2252 | 14.05 | 0.814 |
| | E | 12 | 3.60 | 0.1355 | 0.2115 | 12.02 | 0.691 |
| II-1 | A | 130 | 3.80 | 0.1650 | 0.2497 | 11.02 | 0.938 |
| | B | 50 | 3.50 | 0.1650 | 0.2368 | 9.36 | 0.796 |
| | C | 60 | 3.20 | 0.1630 | 0.2230 | 7.93 | 0.658 |
| | D | 180 | 3.00 | 0.1625 | 0.2153 | 7.00 | 0.577 |

TABLE 3

| Specifications of Dimples | | | | |
|---|---|---|---|---|
| | I-1 | I-2 | I-3 | II-1 |
| Front view | FIG. 2 | FIG. 2 | FIG. 2 | — |
| Plan view | FIG. 3 | FIG. 3 | FIG. 3 | — |
| Total number | 338 | 338 | 338 | 420 |
| Total volume D ($mm^3$) | 305 | 325 | 345 | 305 |
| Occupation ratio (%) | 82.2 | 82.2 | 82.2 | 64.8 |

TABLE 4

| Evaluation Results | | | | | | |
|---|---|---|---|---|---|---|
| | Ex. 1 | Ex. 2 | Ex. 3 | Ex. 4 | Com. 1 | Com. 2 |
| Core Df (mm) | 4.0 | 4.0 | 4.0 | 4.0 | 4.6 | 4.6 |
| Hs (Shore C) | 78 | 78 | 78 | 78 | 72 | 72 |
| Hc (Shore C) | 58 | 58 | 58 | 58 | 52 | 52 |
| Te (° C.) | 160 | 160 | 160 | 160 | 160 | 160 |
| Tm (min) | 20 | 20 | 20 | 20 | 20 | 20 |
| B = Hs − Hc | 20 | 20 | 20 | 20 | 20 | 20 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | c | c | c | c | c | c |
| To (mm) | 1.25 | 1.25 | 1.25 | 1.25 | 1.25 | 1.25 |
| Ho (Shore D) | 59 | 59 | 59 | 59 | 59 | 59 |
| A (Atti) | 80 | 80 | 80 | 80 | 60 | 60 |
| Cv | 51 | 51 | 51 | 51 | 51 | 51 |
| Cs | 54 | 54 | 54 | 54 | 54 | 54 |
| Dimples | I-1 | II-1 | I-2 | I-3 | I-1 | II-1 |
| D ($mm^3$) | 305 | 305 | 325 | 345 | 305 | 305 |
| Vw | 58.3 | 58.3 | 58.3 | 58.3 | 57.8 | 57.8 |
| Sa | 4129 | 4129 | 4129 | 4129 | 3929 | 3929 |
| 0.04Sa + 160 − 20 | 305 | 305 | 305 | 305 | 297 | 297 |
| 0.04Sa + 160 + 20 | 345 | 345 | 345 | 345 | 337 | 337 |
| a1 ($10^{-5}$) | 320 | 320 | 301 | 282 | 320 | 320 |
| b1 ($10^{-5}$) | 5357 | 5357 | 5731 | 6105 | 5357 | 5357 |
| a2 ($10^{-5}$) | 184 | 184 | 177 | 169 | 184 | 184 |
| b2 ($10^{-5}$) | 9699 | 9699 | 9789 | 9879 | 9699 | 9699 |
| CLU | 0.203 | 0.203 | 0.198 | 0.193 | 0.192 | 0.192 |
| CLL | 0.183 | 0.183 | 0.180 | 0.178 | 0.177 | 0.177 |
| CL | 0.192 | 0.203 | 0.188 | 0.185 | 0.185 | 0.194 |
| Distance (m) | 203.4 | 202.6 | 202.4 | 201.9 | 201.5 | 200.5 |

TABLE 5

| Evaluation Results | | | | | | |
|---|---|---|---|---|---|---|
| | Com. 3 | Com. 4 | Com. 5 | Com. 6 | Ex. 5 | Ex. 6 |
| Core Df (mm) | 4.6 | 4.6 | 3.4 | 3.4 | 3.4 | 3.4 |
| Hs (Shore C) | 72 | 72 | 84 | 84 | 84 | 84 |
| Hc (Shore C) | 52 | 52 | 64 | 64 | 64 | 64 |
| Te (° C.) | 160 | 160 | 160 | 160 | 160 | 160 |
| Tm (min) | 20 | 20 | 20 | 20 | 20 | 20 |
| B = Hs − Hc | 20 | 20 | 20 | 20 | 20 | 20 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | c | c | c | c | c | c |
| To (mm) | 1.25 | 1.25 | 1.25 | 1.25 | 1.25 | 1.25 |
| Ho (Shore D) | 59 | 59 | 59 | 59 | 59 | 59 |
| A (Atti) | 60 | 60 | 100 | 100 | 100 | 100 |
| Cv | 51 | 51 | 51 | 51 | 51 | 51 |
| Cs | 54 | 54 | 54 | 54 | 54 | 54 |
| Dimples | I-2 | I-3 | I-1 | II-1 | I-2 | I-3 |
| D ($mm^3$) | 325 | 345 | 305 | 305 | 325 | 345 |
| Vw | 57.8 | 57.8 | 58.8 | 58.8 | 58.8 | 58.8 |

TABLE 5-continued

| Evaluation Results | | | | | | |
|---|---|---|---|---|---|---|
| | Com. 3 | Com. 4 | Com. 5 | Com. 6 | Ex. 5 | Ex. 6 |
| Sa | 3929 | 3929 | 4329 | 4329 | 4329 | 4329 |
| 0.04Sa + 160 − 20 | 297 | 297 | 313 | 313 | 313 | 313 |
| 0.04Sa + 160 + 20 | 337 | 337 | 353 | 353 | 353 | 353 |
| a1 ($10^{-5}$) | 301 | 282 | 320 | 320 | 301 | 282 |
| b1 ($10^{-5}$) | 5731 | 6105 | 5357 | 5357 | 5731 | 6105 |
| a2 ($10^{-5}$) | 177 | 169 | 184 | 184 | 177 | 169 |
| b2 ($10^{-5}$) | 9789 | 9879 | 9699 | 9699 | 9789 | 9879 |
| CLU | 0.188 | 0.183 | 0.213 | 0.213 | 0.208 | 0.202 |
| CLL | 0.174 | 0.172 | 0.189 | 0.189 | 0.186 | 0.183 |
| CL | 0.181 | 0.178 | 0.199 | 0.211 | 0.195 | 0.191 |
| Distance (m) | 201.2 | 199.7 | 201.1 | 200.4 | 203.2 | 203.7 |

TABLE 6

| Evaluation Results | | | | | | |
|---|---|---|---|---|---|---|
| | Com. 7 | Com. 8 | Ex. 7 | Ex. 8 | Ex. 9 | Ex. 10 |
| Core Df (mm) | 3.8 | 3.8 | 3.8 | 3.8 | 4.2 | 4.2 |
| Hs (Shore C) | 80 | 80 | 80 | 80 | 76 | 76 |
| Hc (Shore C) | 60 | 60 | 60 | 60 | 56 | 56 |
| Te (° C.) | 160 | 160 | 160 | 160 | 160 | 160 |
| Tm (min) | 20 | 20 | 20 | 20 | 20 | 20 |
| B = Hs − Hc | 20 | 20 | 20 | 20 | 20 | 20 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | b | b | b | b | d | d |
| To (mm) | 1.25 | 1.25 | 1.25 | 1.25 | 1.25 | 1.25 |
| Ho (Shore D) | 52 | 52 | 52 | 52 | 66 | 66 |
| A (Atti) | 80 | 80 | 80 | 80 | 80 | 80 |
| Cv | 47 | 47 | 47 | 47 | 54 | 54 |
| Cs | 49 | 49 | 49 | 49 | 59 | 59 |
| Dimples | I-1 | II-1 | I-2 | I-3 | I-1 | II-1 |
| D ($mm^3$) | 305 | 305 | 325 | 345 | 305 | 305 |
| Vw | 58.1 | 58.1 | 58.1 | 58.1 | 58.5 | 58.5 |
| Sa | 4229 | 4229 | 4229 | 4229 | 4029 | 4029 |
| 0.04Sa + 160 − 20 | 309 | 309 | 309 | 309 | 301 | 301 |
| 0.04Sa + 160 + 20 | 349 | 349 | 349 | 349 | 341 | 341 |
| a1 ($10^{-5}$) | 320 | 320 | 301 | 282 | 320 | 320 |
| b1 ($10^{-5}$) | 5357 | 5357 | 5731 | 6105 | 5357 | 5357 |
| a2 ($10^{-5}$) | 184 | 184 | 177 | 169 | 184 | 184 |
| b2 ($10^{-5}$) | 9699 | 9699 | 9789 | 9879 | 9699 | 9699 |
| CLU | 0.207 | 0.207 | 0.201 | 0.196 | 0.199 | 0.199 |
| CLL | 0.185 | 0.185 | 0.182 | 0.180 | 0.180 | 0.180 |
| CL | 0.196 | 0.207 | 0.192 | 0.188 | 0.189 | 0.199 |
| Distance (m) | 200.7 | 200.1 | 201.7 | 202.7 | 204.1 | 203.3 |

TABLE 7

| Evaluation Results | | | | | | |
|---|---|---|---|---|---|---|
| | Ex. 11 | Com. 9 | Com. 10 | Com. 11 | Ex. 12 | Ex. 13 |
| Core Df (mm) | 4.2 | 4.2 | 4.0 | 4.0 | 4.0 | 4.0 |
| Hs (Shore C) | 76 | 76 | 78 | 78 | 78 | 78 |
| Hc (Shore C) | 56 | 56 | 58 | 58 | 58 | 58 |
| Te (° C.) | 160 | 160 | 160 | 160 | 160 | 160 |
| Tm (min) | 20 | 20 | 20 | 20 | 20 | 20 |
| B = Hs − Hc | 20 | 20 | 20 | 20 | 20 | 20 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | d | d | c | c | c | c |
| To (mm) | 1.25 | 1.25 | 0.50 | 0.50 | 0.50 | 0.50 |
| Ho (Shore D) | 66 | 66 | 59 | 59 | 59 | 59 |
| A (Atti) | 80 | 80 | 80 | 80 | 80 | 80 |
| Cv | 54 | 54 | 46 | 46 | 46 | 46 |
| Cs | 59 | 59 | 50 | 50 | 50 | 50 |
| Dimples | I-2 | I-3 | I-1 | II-1 | I-2 | I-3 |
| D ($mm^3$) | 325 | 345 | 305 | 305 | 325 | 345 |

TABLE 7-continued

| | Evaluation Results | | | | | |
|---|---|---|---|---|---|---|
| | Ex. 11 | Com. 9 | Com. 10 | Com. 11 | Ex. 12 | Ex. 13 |
| Vw | 58.5 | 58.5 | 58.1 | 58.1 | 58.1 | 58.1 |
| Sa | 4029 | 4029 | 4210 | 4210 | 4210 | 4210 |
| 0.04Sa + 160 − 20 | 301 | 301 | 308 | 308 | 308 | 308 |
| 0.04Sa + 160 + 20 | 341 | 341 | 348 | 348 | 348 | 348 |
| a1 ($10^{-5}$) | 301 | 282 | 320 | 320 | 301 | 282 |
| b1 ($10^{-5}$) | 5731 | 6105 | 5357 | 5357 | 5731 | 6105 |
| a2 ($10^{-5}$) | 177 | 169 | 184 | 184 | 177 | 169 |
| b2 ($10^{-5}$) | 9789 | 9879 | 9699 | 9699 | 9789 | 9879 |
| CLU | 0.194 | 0.189 | 0.206 | 0.206 | 0.201 | 0.195 |
| CLL | 0.178 | 0.175 | 0.185 | 0.185 | 0.182 | 0.179 |
| CL | 0.185 | 0.181 | 0.195 | 0.206 | 0.191 | 0.187 |
| Distance (m) | 203.1 | 201.5 | 200.8 | 200.2 | 201.7 | 202.6 |

TABLE 8

| | Evaluation Results | | | | | |
|---|---|---|---|---|---|---|
| | Ex. 14 | Ex. 15 | Ex. 16 | Com. 12 | Com. 13 | Com. 14 |
| Core Df (mm) | 4.0 | 4.0 | 4.0 | 4.0 | 4.0 | 4.0 |
| Hs (Shore C) | 78 | 78 | 78 | 78 | 72 | 72 |
| Hc (Shore C) | 58 | 58 | 58 | 58 | 62 | 62 |
| Te (° C.) | 160 | 160 | 160 | 160 | 150 | 150 |
| Tm (min) | 20 | 20 | 20 | 20 | 25 | 25 |
| B = Hs − Hc | 20 | 20 | 20 | 20 | 10 | 10 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | c | c | c | c | c | c |
| To (mm) | 2.00 | 2.00 | 2.00 | 2.00 | 1.25 | 1.25 |
| Ho (Shore D) | 59 | 59 | 59 | 59 | 59 | 59 |
| A (Atti) | 80 | 80 | 80 | 80 | 80 | 80 |
| Cv | 53 | 53 | 53 | 53 | 51 | 51 |
| Cs | 55 | 55 | 55 | 55 | 54 | 54 |
| Dimples | I-1 | II-1 | I-2 | I-3 | I-1 | II-1 |
| D ($mm^3$) | 305 | 305 | 325 | 345 | 305 | 305 |
| Vw | 58.4 | 58.4 | 58.4 | 58.4 | 58.4 | 58.4 |
| Sa | 4096 | 4096 | 4096 | 4096 | 4179 | 4179 |
| 0.04Sa + 160 − 20 | 304 | 304 | 304 | 304 | 307 | 307 |
| 0.04Sa + 160 + 20 | 344 | 344 | 344 | 344 | 347 | 347 |
| a1 ($10^{-5}$) | 320 | 320 | 301 | 282 | 320 | 320 |
| b1 ($10^{-5}$) | 5357 | 5357 | 5731 | 6105 | 5357 | 5357 |
| a2 ($10^{-5}$) | 184 | 184 | 177 | 169 | 184 | 184 |
| b2 ($10^{-5}$) | 9699 | 9699 | 9789 | 9879 | 9699 | 9699 |
| CLU | 0.202 | 0.202 | 0.196 | 0.191 | 0.208 | 0.208 |
| CLL | 0.182 | 0.182 | 0.179 | 0.177 | 0.186 | 0.186 |
| CL | 0.191 | 0.201 | 0.187 | 0.183 | 0.196 | 0.207 |
| Distance (m) | 203.3 | 202.8 | 202.3 | 200.8 | 201.0 | 200.4 |

TABLE 9

| | Evaluation Results | | | | | |
|---|---|---|---|---|---|---|
| | Ex. 17 | Ex. 18 | Ex. 19 | Ex. 20 | Ex. 21 | Com. 15 |
| Core Df (mm) | 4.0 | 4.0 | 4.0 | 4.0 | 4.0 | 4.0 |
| Hs (Shore C) | 72 | 72 | 84 | 84 | 84 | 84 |
| Hc (Shore C) | 62 | 62 | 54 | 54 | 54 | 54 |
| Te (° C.) | 150 | 150 | 170 | 170 | 170 | 170 |
| Tm (min) | 25 | 25 | 15 | 15 | 15 | 15 |
| B = Hs − Hc | 10 | 10 | 30 | 30 | 30 | 30 |
| Inner cover | a | a | a | a | a | a |
| Ti (mm) | 1.00 | 1.00 | 1.00 | 1.00 | 1.00 | 1.00 |
| Hi (Shore D) | 40 | 40 | 40 | 40 | 40 | 40 |
| Outer cover | c | c | c | c | c | c |
| To (mm) | 1.25 | 1.25 | 1.25 | 1.25 | 1.25 | 1.25 |
| Ho (Shore D) | 59 | 59 | 59 | 59 | 59 | 59 |
| A (Atti) | 80 | 80 | 80 | 80 | 80 | 80 |
| Cv | 51 | 51 | 51 | 51 | 51 | 51 |
| Cs | 54 | 54 | 54 | 54 | 54 | 54 |
| Dimples | I-2 | I-3 | I-1 | II-1 | I-2 | I-3 |

TABLE 9-continued

| Evaluation Results | | | | | | |
|---|---|---|---|---|---|---|
| | Ex. 17 | Ex. 18 | Ex. 19 | Ex. 20 | Ex. 21 | Com. 15 |
| D ($mm^3$) | 325 | 345 | 305 | 305 | 325 | 345 |
| Vw | 58.4 | 58.4 | 58.2 | 58.2 | 58.2 | 58.2 |
| Sa | 4179 | 4179 | 4079 | 4079 | 4079 | 4079 |
| 0.04Sa + 160 − 20 | 307 | 307 | 303 | 303 | 303 | 303 |
| 0.04Sa + 160 + 20 | 347 | 347 | 343 | 343 | 343 | 343 |
| a1 ($10^{-5}$) | 301 | 282 | 320 | 320 | 301 | 282 |
| b1 ($10^{-5}$) | 5731 | 6105 | 5357 | 5357 | 5731 | 6105 |
| a2 ($10^{-5}$) | 177 | 169 | 184 | 184 | 177 | 169 |
| b2 ($10^{-5}$) | 9789 | 9879 | 9699 | 9699 | 9789 | 9879 |
| CLU | 0.203 | 0.197 | 0.197 | 0.197 | 0.193 | 0.188 |
| CLL | 0.183 | 0.180 | 0.180 | 0.180 | 0.177 | 0.175 |
| CL | 0.192 | 0.188 | 0.188 | 0.198 | 0.185 | 0.181 |
| Distance (m) | 202.0 | 203.0 | 202.7 | 201.7 | 202.5 | 200.5 |

As shown in Tables 4 to 9, the golf ball of each Example has excellent flight performance. From the evaluation results, advantages of the present invention are clear.

The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball comprising a core, an inner cover positioned outside the core, and an outer cover positioned outside the inner cover, wherein the golf ball has a plurality of dimples on a surface thereof, the golf ball satisfies the following mathematical formulas (III) and (V), $$Sa=4500+10(A-0.5B-2Cs), \quad \text{(III)}$$

Sa≥4079, and $$0.04Sa+160-20 \le D \le 0.04Sa+160+20 \quad \text{(V), where}$$

A: a compression (Atti) of the golf ball,

B: a hardness difference (Shore C) between a surface and a center of the core,

Cs: (Hi×Ti+2Ho×To)/(Ti+2To),

D: a dimple total volume ($mm^3$),

Hi: a hardness (Shore D) of the inner cover,

Ho: a hardness (Shore D) of the outer cover,

Ti: a thickness (mm) of the inner cover, and

To: a thickness (mm) of the outer cover.

2. The golf ball according to claim 1, wherein the golf ball further satisfies the following mathematical formula (I), $$Vw=54+0.01(2.5A-B+5Cv), \text{ and} \quad \text{(I)},$$

Vw≥58.0

Cv: (Hi×Ti+Ho×To)/(Ti+To).

3. The golf ball according to claim 1, wherein a lift force coefficient CL of the golf ball satisfies the following mathematical formula (IV), $$CLL \le CL \le CLU \quad \text{(IV)},$$

CLU: $Sw/60\times(-9.5\times10^{-6}\times D+6.1\times10^{-3})+(1.871\times10^{-4}\times D-3.5\times10^{-3})$, CLL: $Sw/60\times(-3.8\times10^{-6}\times D+3.0\times10^{-3})+(4.52\times10^{-5}\times D+8.32\times10^{-2})$, Sw: 3000+10(A−B−1.5Cs).

4. The golf ball according to claim 1, wherein a hardness (shore C) of the center of the core is not less than 35 and not greater than 70.

5. The golf ball according to claim 1, wherein a hardness (shore C) of the surface of the core is not less than 55 and not greater than 95.

6. The golf ball according to claim 1, wherein the hardness difference B is not less than 0 and not greater than 40.

7. The golf ball according to claim 1, wherein an amount of compressive deformation Df of the core is not less than 3.0 mm and not greater than 4.5 mm.

8. The golf ball according to claim 1, wherein the thickness Ti of the inner cover is not less than 0.50 mm and not greater than 1.50 mm.

9. The golf ball according to claim 1, wherein the hardness Hi of the inner cover is not less than 25 and not greater than 75.

10. The golf ball according to claim 1, wherein the thickness To of the outer cover is not less than 0.50 mm and not greater than 2.30 mm.

11. The golf ball according to claim 1, wherein the hardness Ho of the outer cover is not less than 30 and not greater than 75.

12. The golf ball according to claim 1, wherein the index Cs is not less than 25 and not greater than 75.

13. The golf ball according to claim 1, wherein the compression A is not less than 20 and not greater than 120.

14. The golf ball according to claim 1, wherein a ratio of a sum of areas of all the dimples relative to a surface area of a phantom sphere of the golf ball is not less than 78%.

15. The golf ball according to claim 1, wherein a total number of the dimples is not less than 250 and not greater than 450.

16. The golf ball according to claim 1, wherein a total volume D of the dimples is not less than 200 $mm^3$ and not greater than 500 $mm^3$.

17. The golf ball according to claim 2, wherein the index Cv is not less than 25 and not greater than 75.

18. The golf ball according to claim 6, wherein the hardness difference B is not less than 10 and not greater than 20.

19. The golf ball according to claim 10, wherein the thickness To of the outer cover is not less than 1.25 mm and not greater than 2.00 mm.

* * * * *